US009976384B2

(12) United States Patent
Resweber

(10) Patent No.: US 9,976,384 B2
(45) Date of Patent: May 22, 2018

(54) TOE SLEEVE ISOLATION SYSTEM FOR CEMENTED CASING IN BOREHOLE

(71) Applicant: Weatherford Technology Holdings, LLC, Houston, TX (US)

(72) Inventor: Eugene L. Resweber, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 85 days.

(21) Appl. No.: 14/561,693

(22) Filed: Dec. 5, 2014

(65) Prior Publication Data

US 2015/0184489 A1 Jul. 2, 2015

Related U.S. Application Data

(60) Provisional application No. 61/912,361, filed on Dec. 5, 2013.

(51) Int. Cl.
*E21B 34/12* (2006.01)
*E21B 33/14* (2006.01)
(Continued)

(52) U.S. Cl.
CPC ..... *E21B 33/146* (2013.01); *E21B 33/14* (2013.01); *E21B 34/14* (2013.01); *E21B 43/261* (2013.01); *E21B 2034/007* (2013.01)

(58) Field of Classification Search
CPC ..... E21B 33/146; E21B 43/261; E21B 2034/007; E21B 34/14; E21B 33/14
See application file for complete search history.

(56) References Cited

U.S. PATENT DOCUMENTS 3,163,218 A * 12/1964 Willman ..... E21B 33/138 166/205
3,948,322 A * 4/1976 Baker ..... E21B 33/127 166/154
(Continued)

FOREIGN PATENT DOCUMENTS

GB 2360802 A * 10/2001 ..... E21B 21/103
WO 2012/037646 A1 3/2012

OTHER PUBLICATIONS

Int'l Search Report and Written Opinion in counterpart PCT Appl. PCT/US2014/068787, dated Jul. 31, 2015, 10-pgs.
(Continued)

*Primary Examiner* — Nicole Coy
(74) *Attorney, Agent, or Firm* — Blank Rome LLP

(57) ABSTRACT

An apparatus deploys on a casing and has a toe with first and second ports for communicating with a wellbore. A packing element between the ports is actuatable to isolate portions of the wellbore. The toe operates in a first condition for run-in to prevent fluid communication through the ports, although washdown can flow through a toe port. Once installed, the toe operates in a second condition for cementation when the first plug is deployed to the toe. In this condition, the toe actuates the packing element, permits fluid communication through the first port, and prevents fluid communication through the second port. After cementation, the toe operates in a third condition for fracture and completion operations when the second plug is deployed. The toe in this condition prevents fluid communication through the first port, but permits fluid communication through the second port downhole of the set packing element.

31 Claims, 8 Drawing Sheets

(51) Int. Cl.

| | |
|---|---|
| ***E21B 33/127*** | (2006.01) |
| ***E21B 34/14*** | (2006.01) |
| ***E21B 43/26*** | (2006.01) |
| *E21B 34/00* | (2006.01) |

(56) References Cited

U.S. PATENT DOCUMENTS

| | | | | |
|---|---|---|---|---|
| 4,941,535 | A | 7/1990 | Porter et al. | |
| 5,109,925 | A | 5/1992 | Stepp et al. | |
| 5,279,370 | A | 1/1994 | Brandell et al. | |
| 5,314,015 | A * | 5/1994 | Streich | E21B 33/127 166/154 |
| 5,411,095 | A | 5/1995 | Ehlinger et al. | |
| 6,666,273 | B2 | 12/2003 | Laurel | |
| 2002/0174986 | A1 | 11/2002 | Szarka | |
| 2011/0253383 | A1 | 10/2011 | Porter | |
| 2012/0261127 | A1 | 10/2012 | Zhou | |
| 2013/0248192 | A1 | 9/2013 | Cook | |

OTHER PUBLICATIONS

Weatherford, "Stage Cementing Tool Manual;" Manual dated Aug. 29, 2003, 28-pgs.

Weatherford, "Float & Stage Equipment," Brochure copyright 2005, 44-pgs.

Weatherford, "ZoneSelect ® Completions System Time Delay (TD) Toe Sleeve," Brochure copyright 2013, 2-pgs.

Weatherford, "POST(TM) Pack-Off Stage Tool," Brochure copyright 2003-2009, 3-pgs.

Weatherford, "ZoneSelect ® Rupture Disk (RD) Toe Sleeve," Brochure copyright 2013, 2-pgs.

Weatherford, "ZoneSelect(TM) Toe Sleeve," Brochure copyright 2009, 2-pgs.

* cited by examiner

TOE SLEEVE ISOLATION SYSTEM FOR CEMENTED CASING IN BOREHOLE

CROSS-REFERENCE TO RELATED APPLICATIONS

This application claims the benefit of U.S. Provisional Appl. 61/912,361, filed 5 Dec. 2013, which is incorporated herein by reference in its entirety.

BACKGROUND OF THE DISCLOSURE

A wellbore system 20 shown in FIG. 1 has a casing string 22 cemented in a wellbore 10. The casing string 22 has a shoe 30 and a toe sleeve 40 at its end and has various sliding sleeves 50 disposed along its length. The toe sleeve 40 and the sliding sleeves 50 deployed on the casing string 12 can be used to divert treatment fluid to isolated zones of the surrounding formation.

To prepare the system 20, the casing string 22 is run into position in the wellbore 10, and cement is pumped down the casing string 22 ahead of a plug (P). The cement exits the shoe 30 and fills the annulus 12 between the casing string 22 and the wellbore 10. As it is pumped downhole to the shoe 30, the plug (P) does not open the various sleeves 40 and 50 before it eventually reaches the shoe 30. After the cement is set, the toe sleeve 40 and sliding sleeves 50 can be opened so fluid pressure pumped down the casing string 22 can create fractures 14 in the cement 12 and the formation at the ports of the sleeves 40 and 50.

The toe sleeve 40 is opened before the sliding sleeves 50 and typically opens using differential pressure. As shown, the toe sleeve 40 is normally placed at the bottom or "toe" of the casing string 22 with the shoe 30 at the end of the completion, which allows the assembly 100 to be "washed" into position during run-in. When pressure is applied to the casing string 22 once cemented in the wellbore 10, the toe sleeve 40 opens so fracturing operations can begin.

For their part, the sliding sleeves 50 can be opened using a number of techniques. For example, the sliding sleeves 50 can be opened using a shifting tool manipulated downhole on coiled tubing. Alternatively, operators can deploy setting balls to actuate the sliding sleeves 50 in successive stages up the wellbore 10. In this operation, each of the sliding sleeves 50 has a seat (not shown). When operators drop a specifically sized ball down the tubing string 12, the ball engages the sleeve's seat.

Fluid is pumped down the tubing string 22 by a pump system 26 of surface equipment at a rig 24. The applied pressure against the seated ball opens the sliding sleeve 50 so fluid can communicate out ports to the surrounding wellbore 10. Because the zones are treated in stages, the lowermost sliding sleeve 50 has a ball seat for the smallest sized ball size, and successively higher sleeves 50 have larger seats for larger balls. In this way, a specific sized dropped ball will pass though the seats of upper sleeves 50 and will only locate and seal at a desired seat in the casing string 22.

As noted above, the toe sleeve 40 is typically a differential opening sleeve. FIGS. 2A-2B illustrate an example of a toe sleeve 40 according to the prior art in closed and opened conditions. The toe sleeve 40 includes a housing 42 with an internal bore 44. A sleeve 46 disposed in the housing's bore 44 is held sealed in a closed position (FIG. 2A) relative to ports 48 by shear pins 47 or the like. When pressure is increased in the bore 44 relative to the external pressure to a predetermined level, the shear pins 47 break, and the sleeve 46 slides open relative to the ports 48 (FIG. 2B) by decreasing the volume of a sealed chamber 45. Despite the effectiveness of such a toe sleeve 40 of FIGS. 2A-2B for a wellbore system (20) as in FIG. 1, it is possible for the toe sleeve 40 to have difficulty opening when the sleeve 40 has been exposed to cement allowed to cure when the system (20) is cemented in the wellbore (10) in a manner as described above.

The subject matter of the present disclosure is directed to overcoming, or at least reducing the effects of, one or more of the problems set forth above.

SUMMARY OF THE DISCLOSURE

A fracture completion system of the present disclosure includes a toe assembly deployed in a wellbore on a casing string. The casing string and toe assembly are run into the wellbore while the toe assembly is in a first operational condition that allows for washdown. Once deployed in the wellbore, the casing string is cemented in the wellbore when the toe assembly is configured in a second operational condition. In this second condition, a packing element isolates a downhole portion of the toe assembly from the uphole extent of the casing string cemented in the wellbore 10. After cementing the casing string in the wellbore, the toe assembly is configured for a third operational condition in which fluid communication is allowed from the casing string and the toe assembly to the wellbore downhole of the set packing element.

In one implementation, a fracture apparatus for a wellbore has a toe assembly disposed on a casing string in the wellbore. A packing element disposed on the toe assembly separates an uphole port on the assembly from a downhole port on the assembly. A bypass port disposed on the toe assembly downhole of the downhole port can communicate the toe assembly and the casing string with the wellbore.

An inner sleeve is movably disposed in the toe assembly and can be moved from a first condition to a second condition during operations. When the inner sleeve is in the first condition for inserting the casing string and the toe assembly in the wellbore, fluid flow down the casing string can communicate out of the bypass port. At the same time, the uphole port of the assembly is closed by the inner sleeve. Flow out of the downhole port of the assembly is obstructed by a temporary obstruction (e.g., rupture disc) and/or seals.

To perform cementation, a seating plug or ball is deployed downhole to move the inner sleeve from its first condition to a second condition. In this second condition, the packing element on the toe assembly is set. Fluid flow is permitted from the assembly's upper port, while fluid flow out of the second ports is still prevented by the temporary obstruction and/or seals. Additionally, flow out of the bypass is prevented by the inner sleeve. While the toe assembly is in the second condition, cement pumped down the casing string to the toe assembly exits the upper port to cement the casing in the wellbore above the set packing element.

Finally, the toe assembly is set in a third operational condition for permitting fluid communication. A dart or plug is deployed downhole to the inner sleeve. Fluid pressure applied to the inner sleeve against the seated dart then moves the inner sleeve to close off fluid commutation through the uphole port. The seated dart can include a rupture disc, valve, or the like in an internal passage of the dart. In this way, fluid pressure applied from the surface can open flow through this dart. Additionally, the fluid flow can burst the temporary obstruction and/or bypass the seals of the downhole port on the toe assembly to permit fluid flow from the casing string to the wellbore downhole of the packing element.

In another implementation, a fracture completion system of the present disclosure includes a toe assembly deployed in a wellbore on a casing string. The toe assembly includes a float shoe, a toe sleeve, and a stage tool with a packer.

The casing string and toe assembly are run into the wellbore while the toe assembly is in a first operational condition that allows for washdown. Once deployed in the wellbore, an opening plug is deployed downhole in advance of cement. The plug engages an opening seat on the stage tool and shifts an internal sleeve to an intermediate position. Inflation channels in the stage tool then inflate the inflatable packer element on the stage tool to isolate the toe sleeve and float shoe from the casing string uphole.

When a setting pressure is reached, inflation of the packer element is stopped, and the stage tool's ports are opened so cement can pass out of the stage tool and into the annulus above the set packer. After cementing the casing string in the wellbore, a closing plug is deployed down the casing string to a closing seat in the stage tool. Applied pressure behind the seated plug then closes the stage tool.

To open the toe sleeve, the plugs remaining in the stage tool are dissolved, degraded, or otherwise removed so fluid pressure can be applied to the toe sleeve. With the application of hydraulic pressure, the toe sleeve opens allowing communication to the borehole annulus downhole of the set packer element.

The foregoing summary is not intended to summarize each potential embodiment or every aspect of the present disclosure.

DETAILED DESCRIPTION OF THE DISCLOSURE

Figure 3:
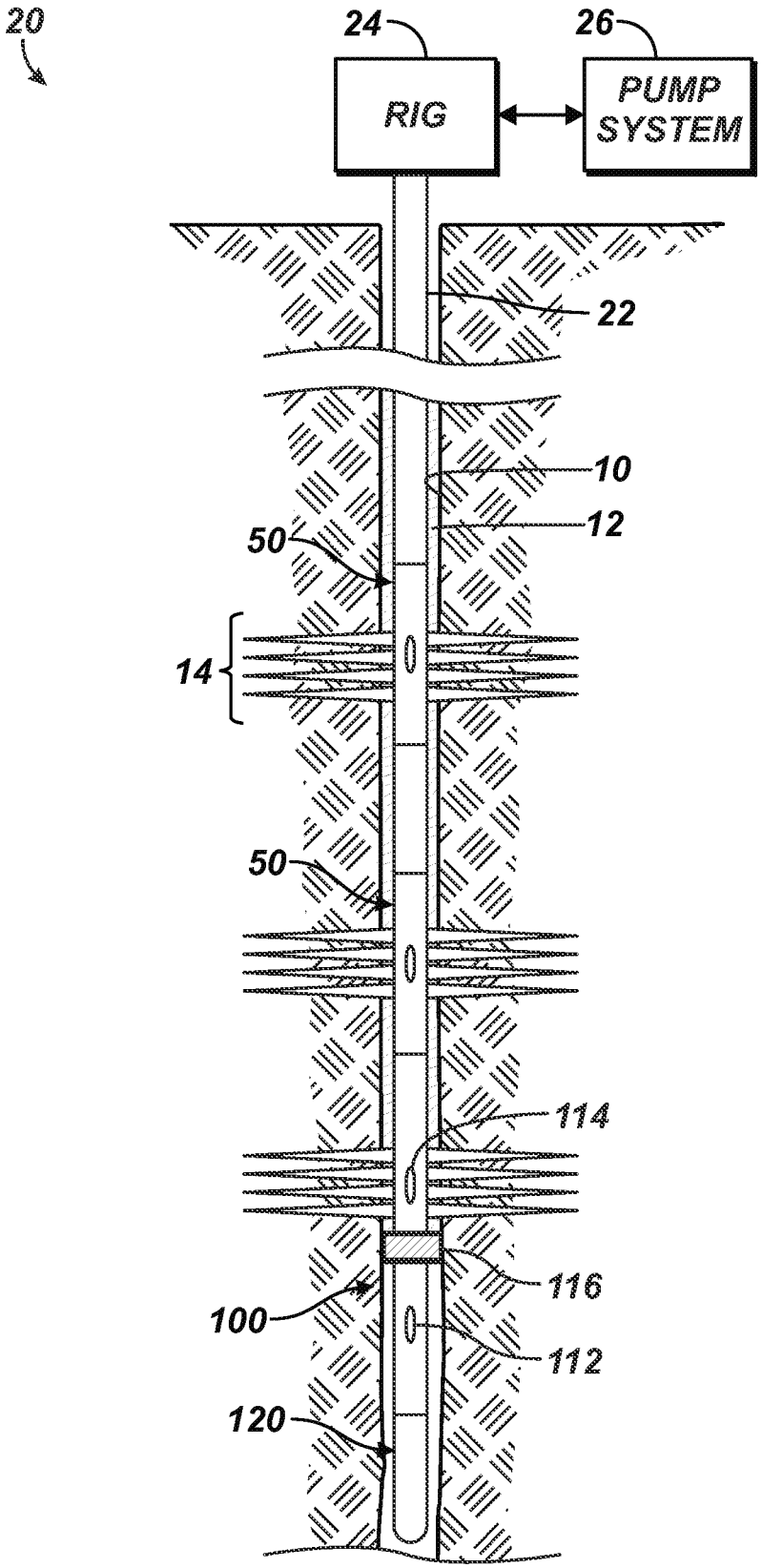
FIG. 3 illustrates a fracture completion system according the present disclosure for fracturing zones of a wellbore.

A fracture completion system 20 shown in FIG. 3 has a casing string 22 cemented in a wellbore 10. The casing string 22 has a toe assembly 100 according to the present disclosure at its end. As depicted here, the casing string 22 has various sliding sleeves 50 disposed along its length, although other implementations can be used. In particular, the toe assembly 100 can be used with a casing string 22 in plug and perforation operations so that the casing string 22 may lack sliding sleeves 50. Either way, the sliding sleeves 50 deployed on the casing string 22 or perforations made in the casing string 22 can be used to divert treatment fluid to isolated zones of the surrounding formation.

To prepare the system 20, the casing string 22 is run into position in the wellbore 10. A packing element 116 on the assembly 100 is activated, and cement is pumped down the casing string 22 ahead of a plug (not shown). The cement exits an uphole port 114 on the assembly 100 and fills the annulus 12 between the casing string 22 and the wellbore 10. As it is pumped downhole to the assembly 100, the plug does not open the various sleeves 50. After the cement is set, the toe assembly 100 can be opened so flow can pass down the casing string 22 and out a downhole port 112. At this point, fracture operations can open the sliding sleeves 50 with dropped balls, plug and perforation operations can create perforations in the casing string 22, or other operations can be performed so fluid pressure pumped down the casing string 22 can create fractures 14 in the cement 12 and the formation at desired intervals.

Figure 4A:
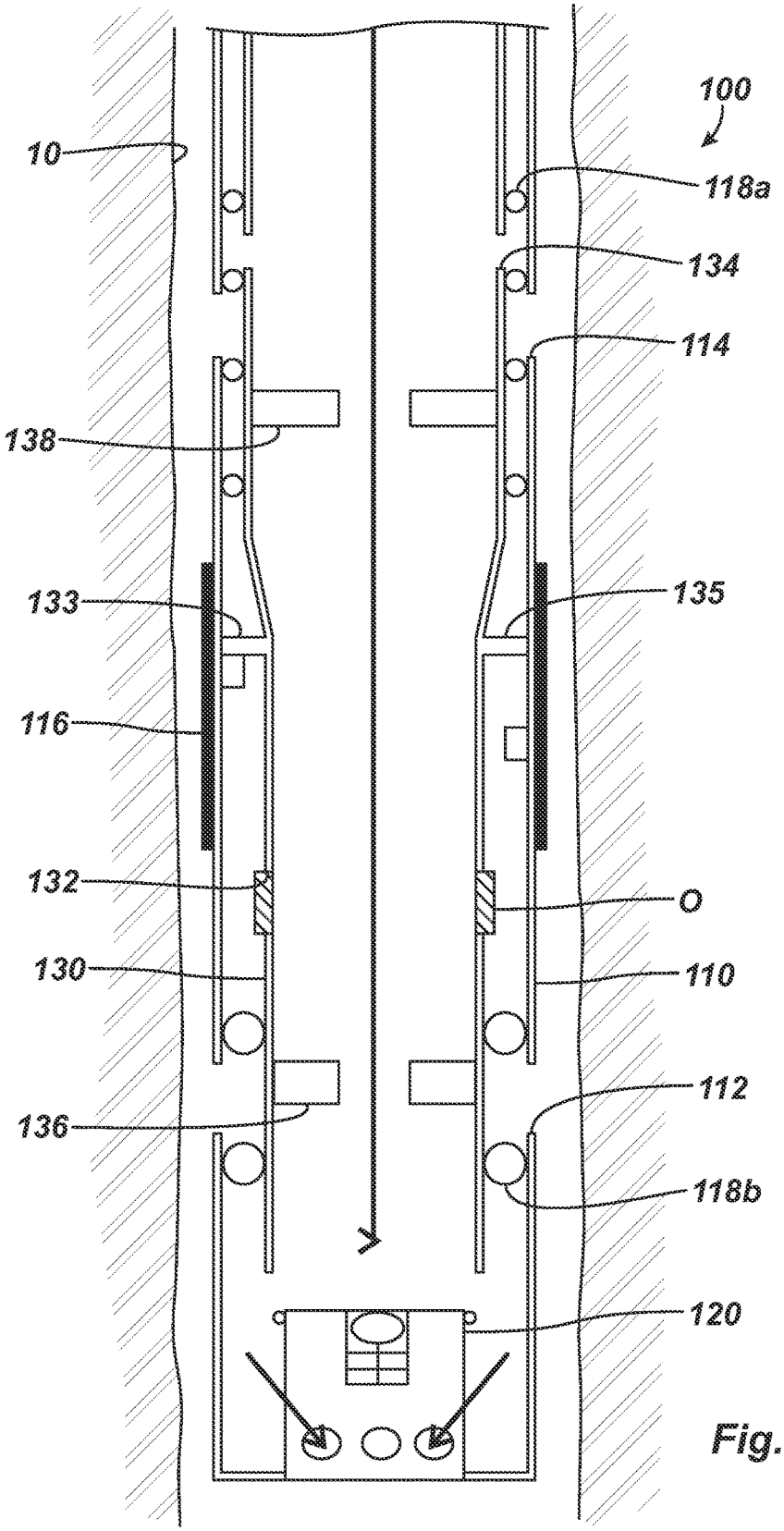
FIG. 4A illustrates a toe assembly in a first operational condition according to the present disclosure for the fracture completion system.

FIG. 4A illustrates the toe assembly 100 in a first operational condition according to the present disclosure. The assembly 100 has a housing 110 with downhole external ports 112 and uphole external ports 114 separated by a packing element 116. Toward the downhole end of the housing 110, a bypass port 120 has a one-way float valve.

Disposed inside the housing 110, an inner sleeve or insert 130 can shift between operational positions as discussed in more detail below. The inner sleeve 130 has downhole ports or outlets 132 and uphole ports or outlets 134 that can selectively communicate with the respective external ports 112 and 114 of the housing 110. The sleeve's ports or outlets 132 and 134 can be sealed from communicating with the external ports 112 and 114 with an arrangement of seals 118*a-b*. Also, the downhole ports or outlets 132 may have burst discs or other temporary obstructions (O) to prevent premature flowback of fluid during operations. The inner sleeve 130 also includes a first (ball) seat 136 and a second (dart) seat 138.

Two shear coupling arrangements 133 and 135 connect the inner sleeve 130 in the housing 110 and control the sleeve's shifting during operations. Body lock rings (not shown) and other known features can be used in the movable arrangement of the inner sleeve 130 in the housing 110. The housing 110 can include any suitable subassemblies, mandrels, and the like. The packer 116 can include an inflatable packing element, a compression-set packing element, or other type of packing element. Preferably, the packer 116 has an inflatable packing element that can be inflated during the cementing operations as discussed below.

In the first operational condition of FIG. 4A, the assembly 100 is shown during run in and washdown as the casing string (22) and the attached toe assembly 100 are run into position. During this process, the uphole external ports or outlets 134 are closed from flow through the inner sleeve 130. The bypass port 120, however, allows for one-way fluid flow out of the assembly 100.

Figure 4B:
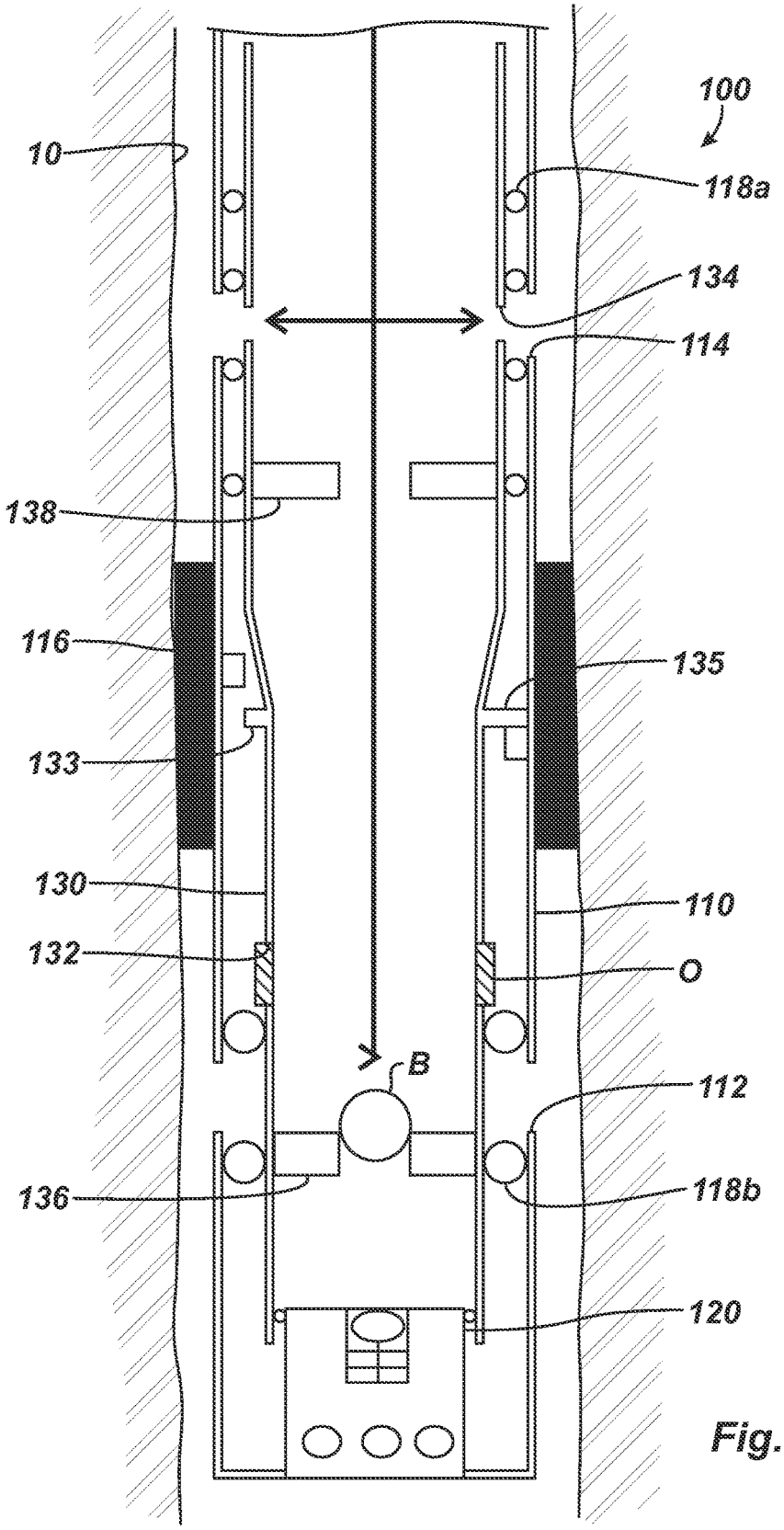
FIG. 4B illustrates the toe assembly in a second operational condition according to the present disclosure.

When the assembly 100 is set in the wellbore 10 in the desired position, the assembly 100 is prepared for its second operational condition, which involves cementing the casing string (22) uphole of the assembly 100 in the wellbore 10. As shown in FIG. 4B, operators drop a ball B or other type of plug downhole and pump the ball B to the first (ball) seat 136 of the assembly 100. Fluid pressure applied against the seated ball B can then shift the inner sleeve 130 inside the housing 100. Flow out of the downhole ports or outlets 132 on the sleeve 130 may be inhibited by temporary obstructions O (e.g., rupture discs, etc.). Additionally or in the alternative, seals 118*a-b* between the inner sleeve 130 and housing 110 can prevent flow out of the downhole ports or outlets 132 when they are not aligned with the housing's external ports 112.

With the applied pressure, the sleeve 130 shears at the first shear coupling 133 so that the inner sleeve's cementing ports or outlets 134 align with the housing's external ports 114. The applied pressure and/or the shifting of the sleeve 110 can also set the packing element 116 disposed on the housing 110 if the element 116 uses a mechanical packer and related components, such as compressible element, piston, etc., which are known in the art and not detailed here. Alternatively, the packing element 116 may be an inflatable packer having inflation channels (not shown) opened when the sleeve 130 shears free of the first shear coupling 133. In yet another alternative, the packing element 116 may use a swell packer made of swellable material that swells when exposed to an activating fluid. As a swell packer, the packing element 116 may be configured to swell rather rapidly to speed up operations, but shifting of the sleeve 130 may not be necessary to set the swell packer element 116.

Figure 1:
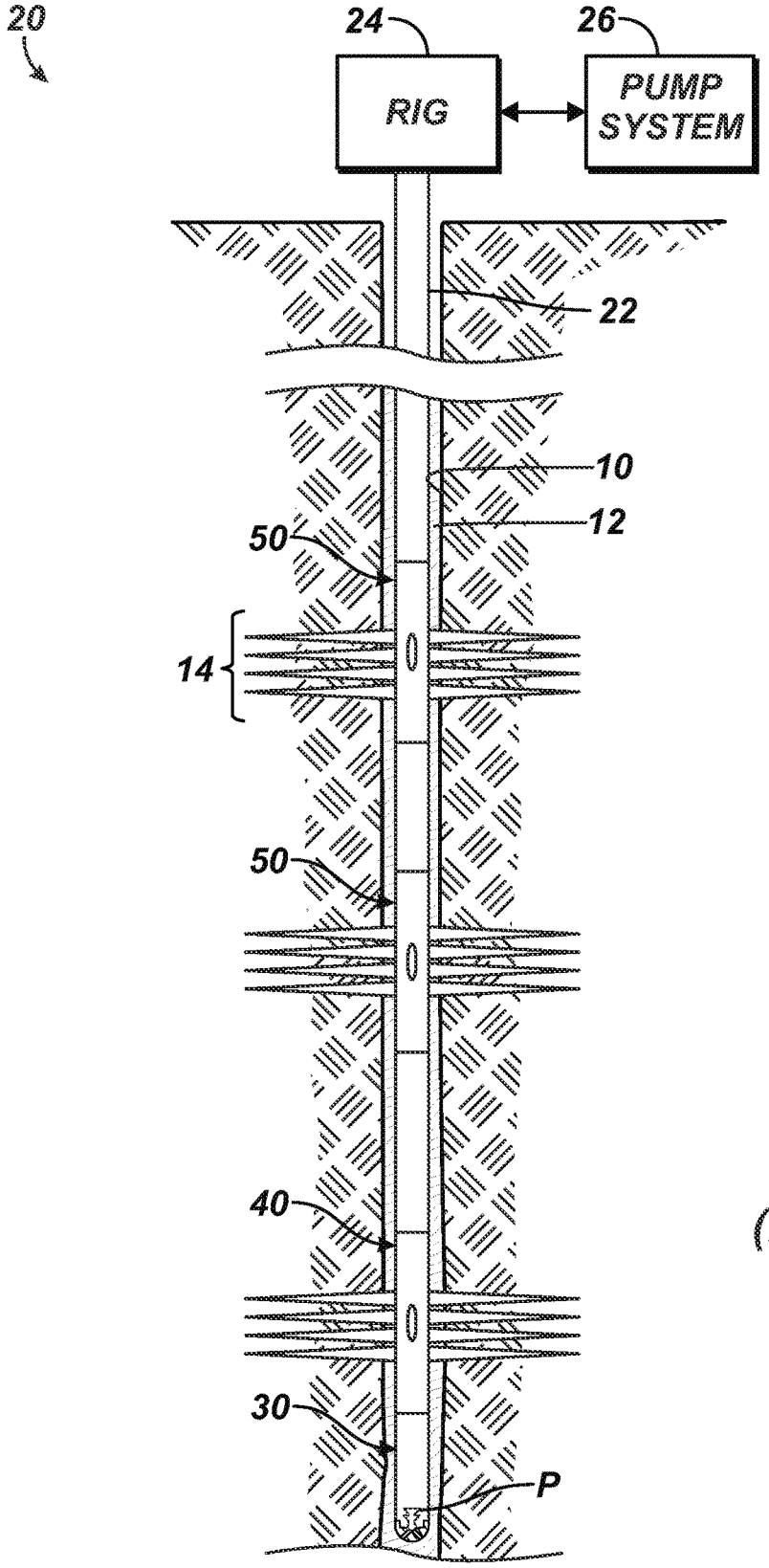
Fig. 1 (Prior Art)
FIG. 1 illustrates a prior art system for fracturing zones of a wellbore.
Figure 2A:
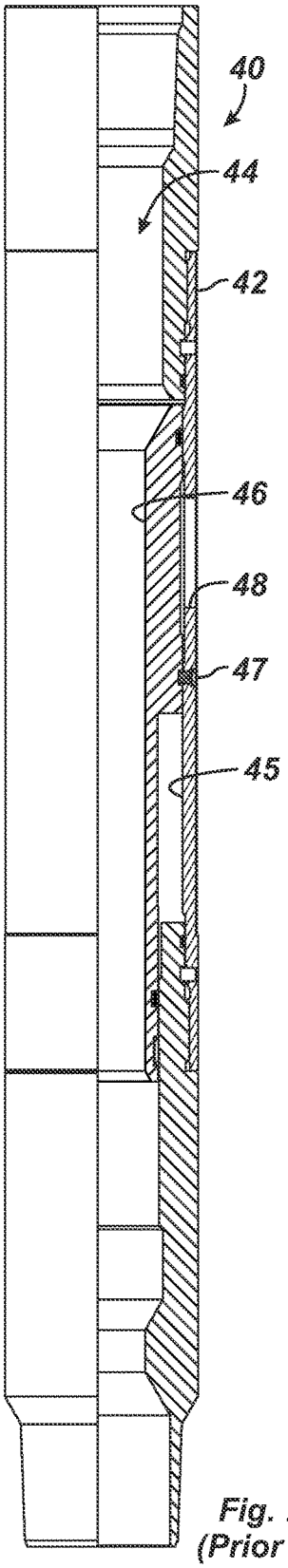
Fig. 2A (Prior Art)
FIGS. 2A-2B illustrate an example of a toe sleeve according to the prior art in closed and opened conditions.
Figure 2B:
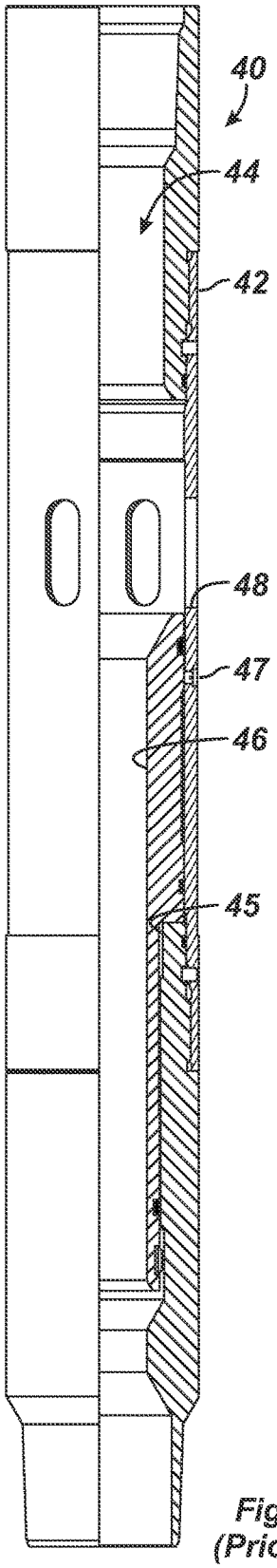
Fig. 2B (Prior Art)

With the packing element 116 set, cement pumped down the casing string (22) to the toe assembly 100 can then flow out of the aligned ports 134 and 114 to cement at least a portion of the assembly 100 and casing string (22) in the wellbore 10. This is in contrast to the conventional practice of flowing cement out of a float shoe beyond a toe sleeve in a typical fracture completion cemented in a wellbore, as described above with reference to FIG. 1. Here, the distal components of the assembly 100 instead remain primarily unexposed to the cement that fills the annulus of the wellbore 10 uphole of the set packing element 116.

To prevent collection of cement in the region of the inner sleeve 130 between the ball seat 136 and the dart seat 138, a dead plug (not shown) may be pumped behind the ball B in advance of the cement so this region is filled with a high viscous fluid or other material.

Figure 4C:
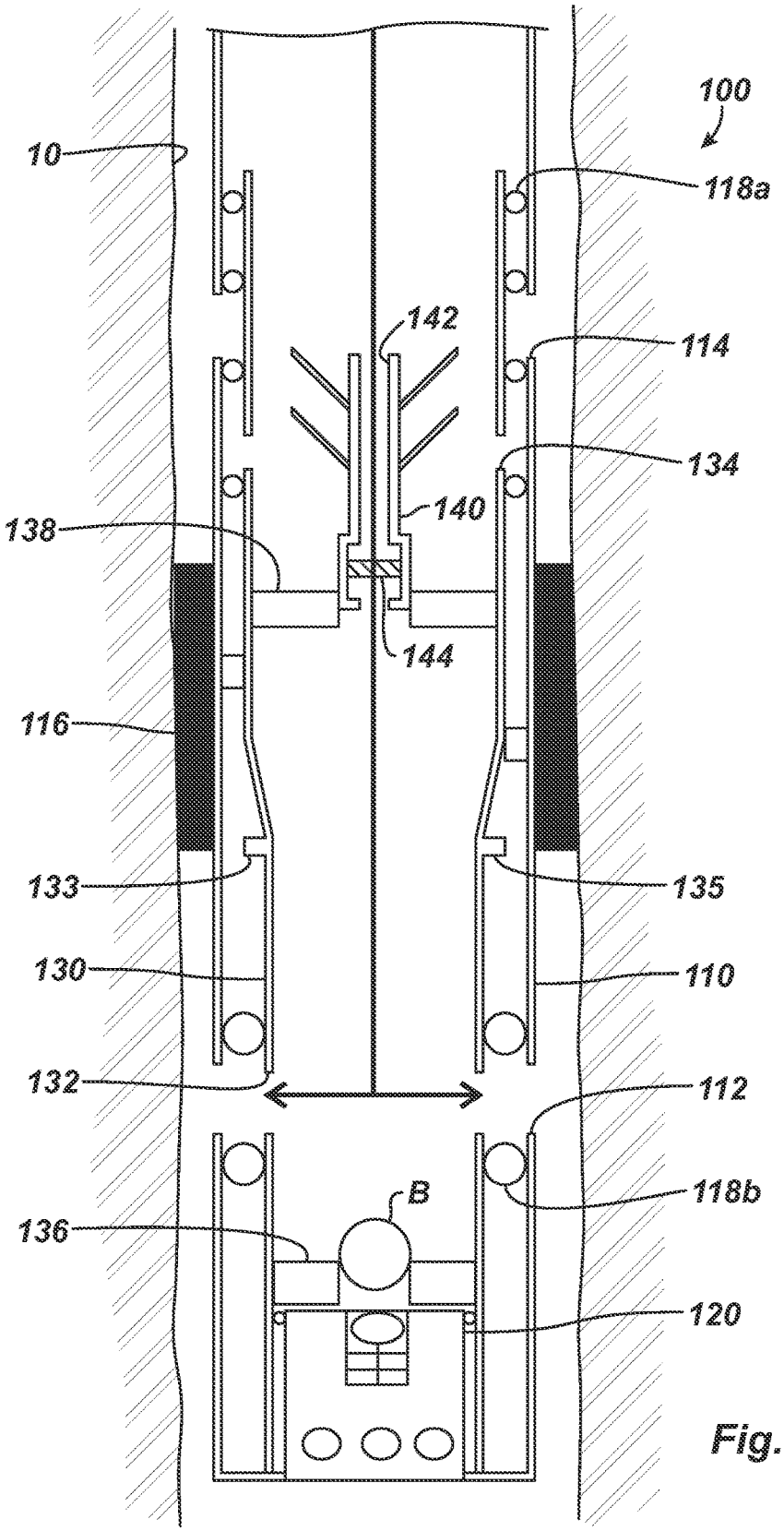
FIG. 4C illustrates the toe assembly in a third operational condition.

Finally, when cementing is nearing completion, operators deploy a wiper plug or dart 140 as shown in FIG. 4C to clear the casing of residual cement. The dart 140 or other similar device travels down the casing string (22) to the assembly 100 and eventually lands on the second (dart) seat 138 of the inner sleeve 130. Pressure applied against the seated dart 140 then overcomes the second shear coupling 135 so that the inner sleeve 130 shifts further in the housing 110. As shown, the uphole ports or outlets 134 on the inner sleeve 130 now shift out of alignment with the external cementing ports 114. Meanwhile, the bypass port 120 with its one-way float valve allows pressure to escape a closed chamber created when inner sleeve 130 shifts in the housing 110.

The dart 140 has an internal passage 142 therethrough with a burst disc or other temporary barrier or obstruction 144, which is set to open at a higher pressure then required to shift the inner sleeve 130 and break the second shear coupling 135. Once the dart 140 is landed and the burst disc 144 ruptured, fluid pressure passing through the dart's passage 142 and the seat 138 can then burst the burst discs or other temporary obstructions (O) covering the sleeve's toe-area ports or outlets 132, which can then communicate with the external toe ports 112 of the assembly 100.

At this point, flow out of the toe of the assembly 100 is allowed through the ports 112 and 132. Provided with this flow path, the assembly 100 allows operators at the surface to deploy a setting ball to seat in a sliding sleeve (50) uphole of the assembly 100 so fracture operations on zones of the surrounding formation can be performed. Alternatively, plug and perforation operations can be performed while the toe assembly 100 allows for flow. These and other completion operations can be performed now that flow has been established through the casing string (22) cemented in the wellbore 10.

FIGS. 5A-5E illustrate another arrangement of a toe assembly 100 according to the present disclosure during various operational conditions. Here, the toe assembly 100 includes a stage tool 150 with a packer element 155, a toe sleeve 160, and a float shoe 170. Although not specifically shown here, the toe assembly 100 can be deployed on a casing string (22) in a wellbore (10) as before in FIG. 3. Additionally, sliding sleeves (50) or perforations (not shown) along the casing string (22) can be provided for fracturing the formation surrounding the wellbore.

The stage tool 150 is disposed uphole of the toe sleeve 160 so that the packer 155 fits between the two. The float shoe 170 is disposed at the end of the assembly 100. The various components 150, 160, and 170 can be coupled together as depicted or may be arranged further apart on the casing string.

The float shoe 170 can be any suitable float shoe with one or more check valves 172 for preventing flow into the assembly 100 from the wellbore. The toe sleeve 160 can be a conventional-type of toe sleeve 160 that opens hydraulically, although other configurations can be used.

The stage tool 150 can be similar to a Model 781 Packoff Stage Tool available from Weatherford International, Inc. As shown, the stage tool 150 includes an internal sleeve 152, an external sleeve 151, an opening seat 154, and a closing seat 156. Additionally, the tool 150 includes an inflatable packer element 155 disposed on the tool's mandrel. As discussed in more detail later, inflation channels 159 available on the stage tool 150 inflate the element 155 to engage the surrounding borehole. As will be appreciated, the inflatable packer element 155 may be significantly longer than depicted here.

Figure 5A:
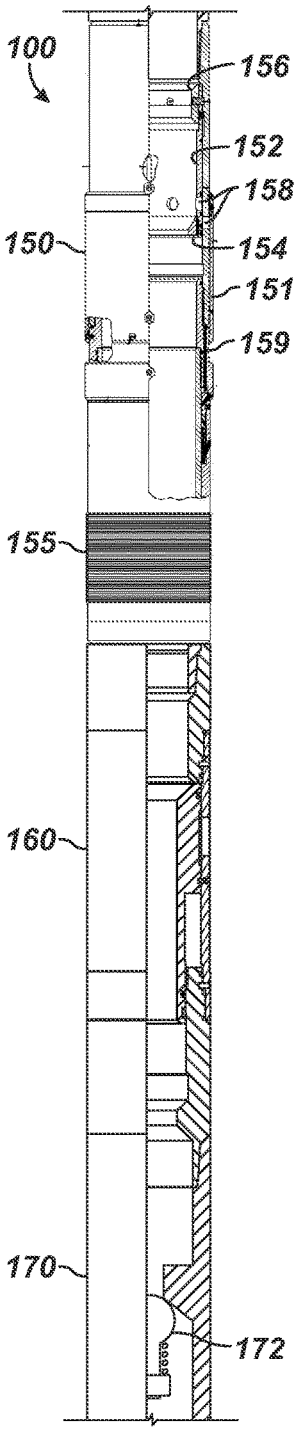
FIGS. 5A-5E illustrate another toe assembly according to the present disclosure during various operational conditions.

As shown in FIG. 5A, the assembly 100 can be run in hole with the stage tool 150 closed so that flow is prevented through ports 158. The packer element 155 is not inflated, and the toe sleeve 160 is closed. The float shoe 170 permits flow out of the assembly 100 beyond the end of the casing string (22) during run-in and washdown. In the run-in position, the stage tool's cementing ports 158 and packer inflation channels 159 are closed by the inner sleeve 152 and the external sleeve 151 with O-ring seals. In this configuration, spaces between the inner sleeve 152, the stage tool body, and the external sleeve 158 are vented to either the inside of the casing or the annulus. The packer element 155 cannot be inflated until the inner sleeve 152 shifts open, as described below.

Figure 5B:
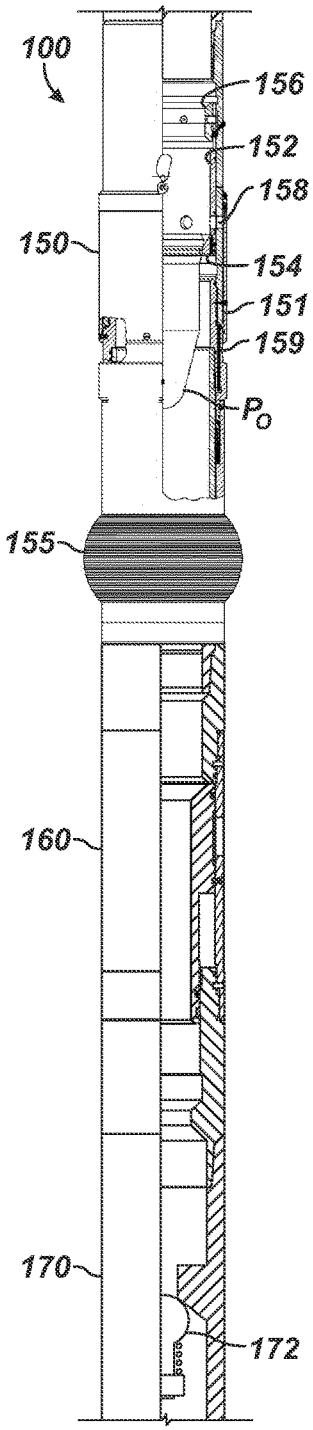

Once the assembly 100 is set in the desired position, the assembly 100 is prepared for its second operational condition, which involves cementing the casing string (22) uphole of the assembly 100 in the wellbore. As shown in FIG. 5B, operators drop an opening plug $P_O$ downhole in advance of cement. The plug $P_O$ eventually engages the opening seat 154 of the stage tool 150, and fluid pressure applied against the seated plug $P_O$ shifts the inner sleeve 152 inside the stage tool 150. At this point, flow can pass through ports 158, the inflation channels 159, and a check valve in the stage tool 150 to inflate the inflatable packer element 155.

In particular, with the opening plug $P_O$ seated, hydraulic pressure is increased by 400 to 1000 psi within the casing string (22) above the opening plug $P_O$ until the shear screws are sheared between the stage tool's body and the inner sleeve 152. The inner sleeve 152 moves downward until its movement is stopped when intermediate locking lugs contact a lower end of a lug recess in the tool's body. In this position, the inner sleeve's ports 158 align with the tool's body ports 158, allowing fluid to flow from inside the casing string (22) into the inflatable packer element 155 through inflation channels 159 and check valve.

To inflate the packer element 155 and open the stage tool 150 for circulation and cementing as discussed above, the opening plug $P_O$ can be a weighted cone as depicted. The plug $P_O$ dropped into the casing string (22) gravitates to the opening seat 154. Given that the plug $P_O$ can be a large cone as shown, the toe assembly 100 in the present arrangement may not be suited for use with sliding sleeves and dropped balls in a fracture system. Instead, the toe assembly 100 as depicted here may be better suited for a plug and perforation operation in the casing. Of course, instead of the cone as shown here, other types of plugs (e.g., balls, darts, cylinders, etc.) can be used, which may allow the assembly 100 to be used with sliding sleeves and other uphole components having more restrictive or narrower passages, seats, and the like.

Figure 5C:
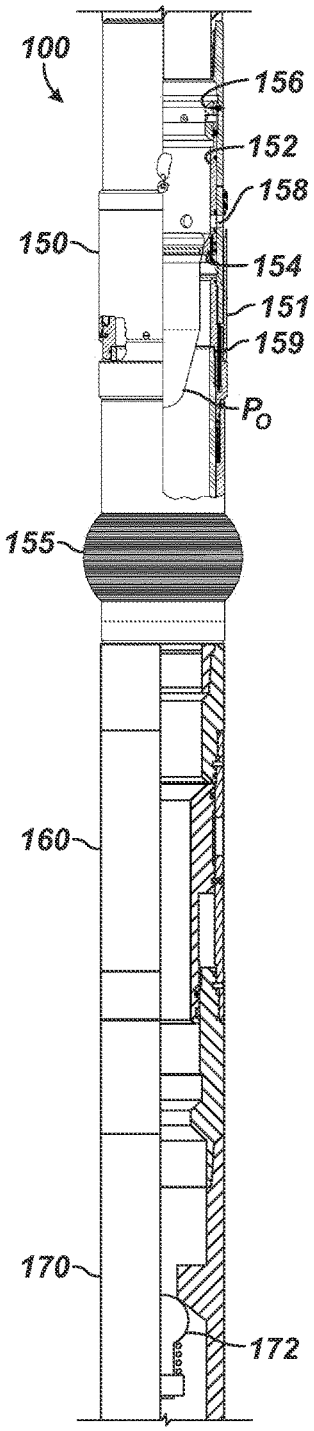

Eventually, after setting the inflatable packer element 155, the external sleeve 151 moves open as shown in FIG. 5C so that flow of the cement in the tool 150 passes out of the ports 158 and into the borehole annulus. In particular, pressure applied within the casing string (22) is diverted into the packer element 155 until a setting pressure is reached. When the setting pressure is reached, external shear screws are sheared, and the external sleeve 151 is forced downward by pressure acting on the differential area between the upper and lower seals on the external sleeve 151. Flow can now pass out of the ports 158 into the annulus. All the while, the seated opening plug $P_O$ prevents the pumped cement from passing further down the assembly 100. The cement fills the annulus uphole of the inflated packer element 155.

Figure 5D:
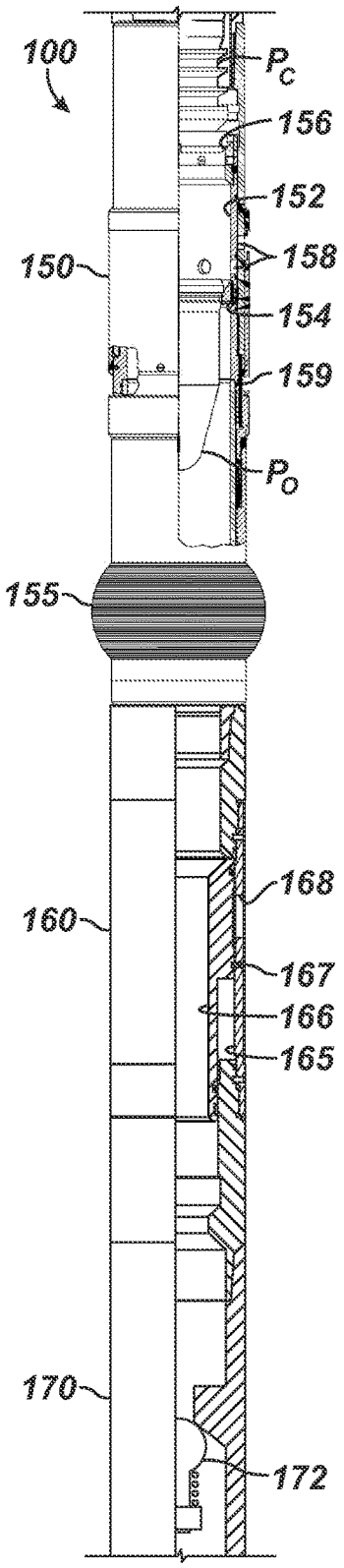
Figure 5E:
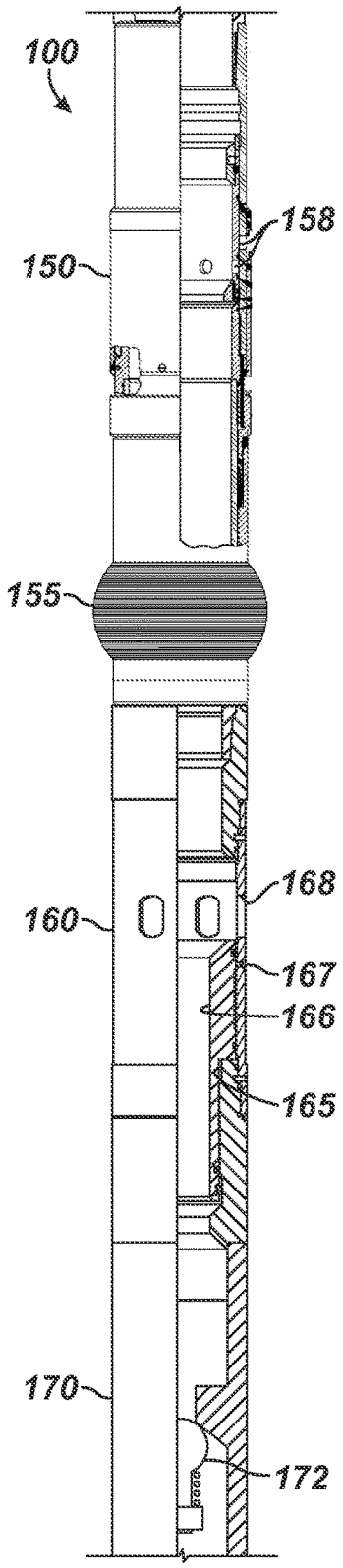

To close the tool's ports, a closing plug $P_C$, such as a wiper plug following the cement, is pumped down the casing string (22) to the tool's closing seat 156. As shown in FIG. 5D, operators deploy the closing plug $P_C$ downhole behind the pumped cement, and the closing plug $P_C$ engages the closing seat 156. Pressure (800 to 1500-psi above circulation pressure depending upon size) applied within the casing string (22) above the closing plug $P_C$ shears shear screws between the inner sleeve 152 and the closing seat 156 and moves the closing seat 156 downward until it contacts the end of the recess in the inner sleeve 152. The intermediate locking lugs are then cammed into a recess in the closing seat 156, and the entire inner sleeve 152 is forced downward under pressure until it contacts an adapter sub inside the tool 150. The inner sleeve 152 with O-ring seals closes the ports 158 in the stage tool body.

As can be seen, the toe assembly 100 has both seated opening and closing plugs $P_O$ and $P_C$ remaining once cementing operations are complete. These plugs $P_O$ and $P_C$ are composed of a degradable or dissolvable material known in the art so that flow through the assembly 100 is eventually re-established. As noted below, milling of the plugs $P_O$ and $P_C$ could also be performed. With the plugs $P_O$ and $P_C$ dissolved or otherwise removed, the toe sleeve 160 can be opened with hydraulic pressure so that the internal sleeve 166 moves open, reducing the internal volume 165 and allowing flow out of the toe sleeve's ports 168.

At this point, flow to the toe of the assembly 100 is allowed through the ports 168. Provided with this flow path, the assembly 100 allows operators at the surface to deploy setting balls to open sliding sleeves (50), perform plug and perforation operations, or conduct other steps uphole of the assembly 100 so fracture operations on zones of the surrounding formation can be performed.

The opening and closing seats 154 and 156 can be made of aluminum, which may be drilled out when milling operations are performed to clear out residual cement. The plugs $P_O$ and $P_C$ can also be milled out if necessary.

As noted previously, historical solutions have not allowed the full string to be cemented without contamination of a toe sleeve. The toe assembly 100 of the present disclosure overcomes these and other drawbacks.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A completion apparatus deployed in a wellbore on a tubing string and operable with first and second plugs, the apparatus comprising:

a toe deployed in the wellbore on the tubing string and having first and second ports for communicating between the wellbore and a bore of the toe;

an inner sleeve movably disposed in the bore of the toe relative to the first and second ports, the inner sleeve being movable from a first position to a second position in response to the first plug and being movable from the second position to a third position in response to the second plug; and a packing element disposed on the toe between the first and second ports and actuatable to isolate uphole and downhole portions of the wellbore, the toe being operable in a first condition with the inner sleeve in the first position preventing fluid communication through the first and second ports, the toe being operable from the first condition to a second condition with the inner sleeve moved from the first position to the second position in response to the first plug deployed to the toe, the toe in the second condition actuating the packing element, permitting fluid communication through the first port uphole of the packing element, and preventing fluid communication through the second port, the toe being operable from the second condition to a third condition with the inner sleeve moved from the second position to the third position in response to the second plug deployed to the toe, the toe in the third condition preventing fluid communication through the first port uphole of the packing element and permitting fluid communication through the second port downhole of the packing element.

2. The apparatus of claim 1, wherein the toe has a toe port downhole of the second port, and wherein the toe in the first condition permits fluid communication through the toe port.

3. The apparatus of claim 1, wherein the toe has a toe port downhole of the second port, and wherein the inner sleeve in the first position prevents fluid communication through the first and second ports and permits fluid communication between the wellbore and the bore of the toe through the toe port.

4. The apparatus of claim 1, wherein first seals seal off fluid communication between a first outlet on the inner sleeve in the first position and the first port on the toe.

5. The apparatus of claim 4, wherein the first seals seal the first outlet on the inner sleeve in the second position in fluid communication with the first port on the toe for communicating the tubing string with the wellbore uphole of the packing element.

6. The apparatus of claim 4, wherein the first seals seal off fluid communication between the first outlet on the inner sleeve in the third position and the first port on the toe.

7. The apparatus of claim 4, wherein second seals seal off fluid communication between a second outlet on the inner sleeve in the first position and the second port on the toe.

8. The apparatus of claim 7, wherein the second seals seal off fluid communication between the second outlet on the inner sleeve in the second position and the second port on the toe.

9. The apparatus of claim 7, wherein the second seals seal the second outlet on the inner sleeve in the third position in fluid communication with the second port on the toe for communicating the tubing string with the wellbore downhole of the packing element.

10. The apparatus of claim 7, further comprising an obstruction at least temporarily closing off fluid communication through the second outlet on the inner sleeve with the second port on the toe.

11. The apparatus of claim 1, wherein the inner sleeve comprises a first seat engaging the first plug, the inner sleeve moving from the first position to the second position in response to applied pressure against the engaged first plug.

12. The apparatus of claim 11, wherein the toe comprises a first retainer retaining the inner sleeve in the first position in the toe and releasing the inner sleeve to move to the second position in response to a level of the applied pressure against the engaged first plug.

13. The apparatus of claim 11, wherein the inner sleeve comprises a second seat engaging the second plug, the inner sleeve moving to the third position in response to applied pressure against the engaged second plug.

14. The apparatus of claim 13, wherein the toe comprises a second retainer retaining the inner sleeve in the second position in the toe and releasing the inner sleeve to move to the third position in response to a level of the applied pressure against the engaged second plug.

15. The apparatus of claim 13, comprising the second plug as part of the apparatus, the second plug defining a flow passage therethrough and having a barrier temporarily preventing fluid communication through the flow passage, the barrier opening fluid communication through the flow passage in response to a level of the applied pressure against the engaged second plug.

16. A completion apparatus deployed in a wellbore on a tubing string and operable with first and second plugs, the apparatus comprising:

a toe deployed in the wellbore on the tubing string and having first and second ports for communicating between the wellbore and a bore of the toe;

a first insert movably disposed in the bore of the toe relative to the first port, the first insert being movable from a first closed position to an opened position in response to the first plug and being movable from the opened position to a second closed position in response to the second plug;

a second insert movably disposed in the bore of the toe and being movable relative to the second port; and a packing element disposed on the toe between the first and second ports and actuatable to isolate uphole and downhole portions of the wellbore, the toe being operable in a first condition with the first insert in the first closed position preventing fluid communication through the first port and with the second insert preventing fluid communication through the second port, the toe being operable from the first condition to a second condition with the first insert moved from the first closed position to the opened position in response to the first plug deployed to the toe, the toe in the second condition actuating the packing element, permitting fluid communication through the first port uphole of the packing element, and preventing fluid communication through the second port, the toe being operable from the second condition to a third condition with the first insert moved from the opened position to the second closed position in response to the second plug deployed to the toe, the toe in the third condition preventing fluid communication through the first port uphole of the packing element, the second insert permitting fluid communication through the second port downhole of the packing element.

17. The apparatus of claim 16, wherein the first insert comprises a first seat engaging the first plug and moving from the first closed position to the opened position relative to the first port to change the toe from the first condition to the second condition.

18. The apparatus of claim 17, wherein the toe defines a flow passage communicating fluid from the tubing string to inflate the packing element when the first insert is in the opened position.

19. The apparatus of claim 17, wherein the first insert comprises a second seat engaging the second plug and moving from the opened position to the second closed position relative to the first port to change the toe from the second condition to an intermediate condition preventing fluid communication through the first and second ports.

20. The apparatus of claim 19, wherein the second insert changes the toe from the intermediate condition to the third condition in response to fluid pressure applied after removal of the first and second plugs.

21. A completion apparatus deployed in a wellbore on a tubing string, the apparatus comprising:

first and second self-removing plugs;

a packing element disposed on the apparatus and actuatable to isolate uphole and downhole portions of the wellbore;

a stage tool disposed uphole of the packing element, the stage tool having a first port and having a first insert movable in the stage tool relative to the first port; and a toe sleeve disposed downhole of the packing element, the toe sleeve having a second port and having a second insert movable in the toe sleeve relative to the second port, the apparatus being operable in a first condition with the first and second inserts closed relative to the first and second ports and preventing fluid communication through the first and second ports, the apparatus being operable in a second condition with the first insert of the stage tool moved opened relative to the first port in response to the first self-removing plug, the apparatus in the second condition actuating the packing element, permitting fluid communication through the first port uphole of the packing element, and preventing fluid communication through the second port, the apparatus being operable in a third condition with the first insert of the stage tool moved closed relative to the first port in response to the second self-removing plug, the apparatus in the third condition preventing fluid communication through the first port uphole of the packing element, the first and second plugs self-removing and permitting the second insert of the toe sleeve to move open with respect to the second port in response to fluid pressure applied after removal of the first and second plugs to permit fluid communication through the second port downhole of the packing element.

22. The apparatus of claim 21, wherein the apparatus comprises a float shoe disposed downhole of the toe sleeve and having a toe port.

23. A completion method, comprising:

changing a toe on a tubing string in a wellbore from a first condition to a second condition by moving an inner sleeve disposed in the toe from a first position to a second position in response to a first plug deployed to the inner sleeve of the toe;

actuating a packing element on the toe in the second condition;

operating the toe in the second condition by permitting fluid communication through a first port uphole of the packing element and preventing fluid communication through a second port downhole of the packing element with the inner sleeve in the second position being opened with respect to the first port and being closed relative to the second port;

changing the toe from the second condition to a third condition by moving the inner sleeve disposed in the toe from the second position to a third position in response to a second plug deployed to the inner sleeve of the toe; and operating the toe in the third condition by preventing fluid communication through the first port and permitting fluid communication through the second port with the inner sleeve in the third position being closed with respect to the first port and being opened relative to the second port.

24. The method of claim 23, wherein operating the toe in the second condition comprises cementing the tubing string uphole of the packing element through the first port.

25. The method of claim 24, wherein operating the toe in the third condition comprises opening fluid communication of the tubing string with the wellbore downhole of the packing element through the second port after cementing the tubing string in the wellbore.

26. The method of claim 23, wherein changing the toe from the first condition to the second condition by moving the inner sleeve in the toe from the first position to the second position in response to the first plug deployed to the inner sleeve comprises seating the first plug on a first seat disposed in the inner sleeve and applying fluid pressure against the first plug seated in the inner sleeve.

27. The method of claim 26, wherein changing the toe from the second condition to the third condition by moving the inner sleeve disposed in the toe from the second position to the third position in response to the second plug deployed to the inner sleeve of the toe comprises seating the second plug on a second seat disposed in the inner sleeve uphole of the first seat; applying fluid pressure against the second plug seated in the inner sleeve; and moving the inner sleeve to close off fluid communication through the first port.

28. The method of claim 27, further comprising opening fluid communication through the seated second plug permitting the fluid communication from the tubing string to the wellbore downhole of the packing element through the second port.

29. The method of claim 23, wherein actuating the packing element on the toe in the second condition comprises inflating the packing element with fluid communicated through inflation channels in the toe.

30. The method of claim 23, wherein operating the toe in the second condition comprises passing cement out of the first port on the toe and into the annulus uphole of the packing element.

31. The method of claim 23, wherein changing the toe from the second condition to the third condition in response to the second plug deployed to the toe comprises closing the inner sleeve with a closing plug as the second plug deployed downhole after cementing the tubing string in the wellbore.

* * * * *